US006350009B1

(12) United States Patent
Freund et al.

(10) Patent No.: US 6,350,009 B1
(45) Date of Patent: Feb. 26, 2002

(54) ENDLESS TRANSPORT BELT FOR RECEIVING THE INK, NOT EJECTED FOR PRINTING PURPOSES, OF AN INKJET PRINTER

(75) Inventors: Michael N. Freund, Adelberg; Kurt Stehle, Neuffen, both of (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/535,885

(22) Filed: Mar. 27, 2000

(30) Foreign Application Priority Data

Mar. 31, 1999 (DE) ..... 199 14 562

(51) Int. Cl.[7] ..... B41J 2/165
(52) U.S. Cl. ..... 347/35; 347/101; 347/104
(58) Field of Search ..... 347/35, 101, 104

(56) References Cited

U.S. PATENT DOCUMENTS 5,225,853 A * 7/1993 Kobayashi et al. ..... 346/140 X
5,526,028 A * 6/1996 Rottman ..... 347/23 X
5,717,446 A 2/1998 Teumer et al.
5,992,994 A * 11/1999 Rasmussen et al. ..... 347/104
6,048,060 A * 4/2000 Narushima et al. ..... 347/104
6,247,774 B1 * 6/2001 Muller ..... 347/2 X

* cited by examiner

*Primary Examiner*—Christopher P. Ellis
*Assistant Examiner*—Kenneth W Bower
(74) *Attorney, Agent, or Firm*—Milton S. Sales

(57) ABSTRACT

The invention relates to an endless transport belt for receiving ink, not ejected for printing purposes, of an inkjet printer; said transport belt receiving the ink sprayed thereon during printing of printing material in such a manner that smearing on the back side of the paper is prevented. For this purpose, the transport belt comprises a carrier layer and a support layer for supporting and printing printing materials of differing widths and lengths by means of an inkjet print head, the support layer according to the present invention having a knobbed grid structure with a hydrophobic and ink-rejecting coating.

10 Claims, 2 Drawing Sheets

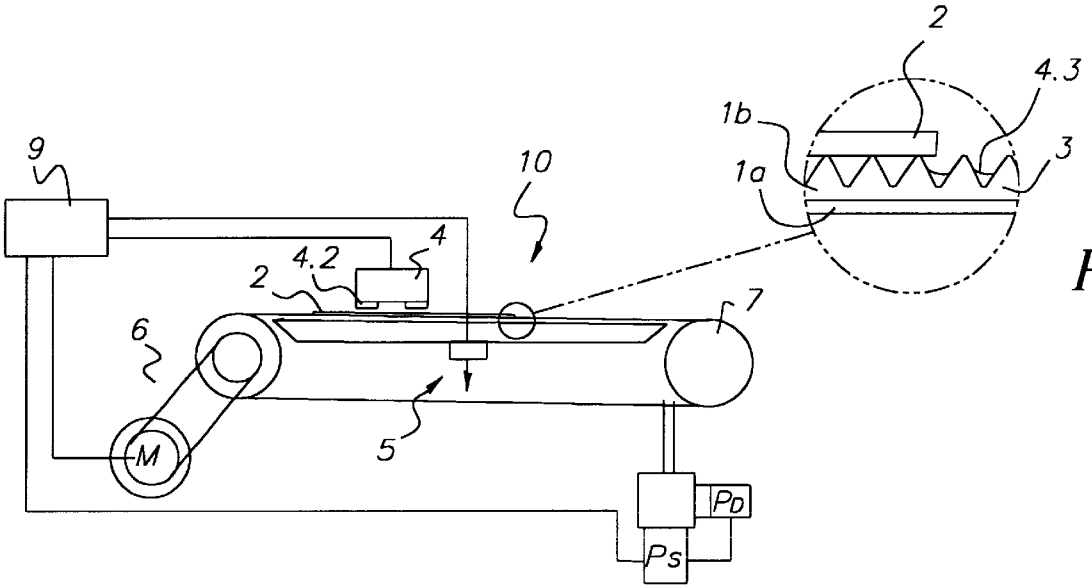
FIG. 4
FIG. 3
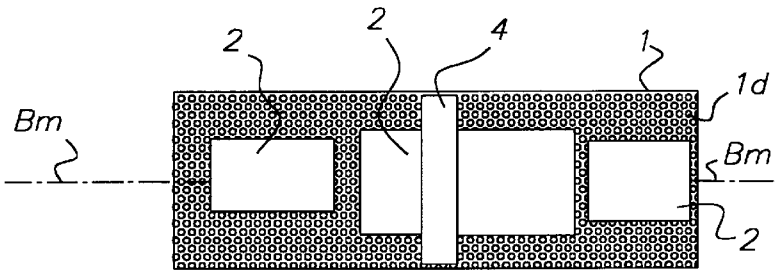
FIG. 5

ENDLESS TRANSPORT BELT FOR RECEIVING THE INK, NOT EJECTED FOR PRINTING PURPOSES, OF AN INKJET PRINTER

FIELD OF THE INVENTION

The invention relates to a transport belt for receiving the ink, not ejected for printing purposes, of an inkjet printer, said belt comprising a carrier layer and a support layer for supporting and printing materials of differing printing width and length by means of an inkjet print head.

BACKGROUND OF THE INVENTION

An inkjet printer is known from German Patent 39 37 860 C2 issued Jan. 16, 1997 which uses a transport belt for paper sheets, in which by means of a charging device the transport belt and the paper can be electrostatically charged with different polarity so that the paper is fixed on the belt, with the electrostatically charged area of the transport belt being wider than the inkjet print head and larger than the paper length. Thus, ink is ejected between the sheets to be printed and, in the case of blind ejection of ink for removal of air bubbles in the print head, ink is drawn onto the transport belt. To clean the transport belt, the latter has an ink attracting layer, not described in detail, which is cleaned by a pair of removal rollers, likewise not described in detail.

The European Patent 0 269 602 B1 issued Jan. 2, 1992 describes a method for drying of a printed material web in which the latter is fixed in non-slip form on a transport belt, passed with the transport belt in a straight line through the dryer and then lifted off the transport belt. Thus, a material web screen-printed using printing ink can be lifted off the transport belt without smudging. The belt is then subjected to wet cleaning.

The disadvantage of the solutions described is that the ink or dye printed onto the endless transport belts is absorbed by the belt and must then be removed by extensive cleaning before the belt area in question is again ready for receiving a new paper sheet or material web. Depending on the porosity of the belt material used and on the viscosity of the ink, the latter is absorbed at differing speeds and achieves varying penetration depths into the belt material. The cleaning process for removing the ink from the belt is correspondingly extensive. If a specific number of ink printing operations has been performed, the belt attains its ink saturation value, after which no further ink is absorbed and the risk of smudging on the printing material cannot be ruled out.

The object underlying the present invention is to provide a transport belt for receiving the excess ink output from an inkjet printer by which ink sprayed onto the transport belt during the printing of printing material is absorbed such that smudging on the back of the paper is prevented. A further object is to prevent ink absorption of the transport belt in order to achieve a longer service life of the belt than that in the prior art.

SUMMARY OF THE INVENTION

In particular, the transport belt for receiving excess ink ejected from an inkjet printer comprises a carrier layer and a support layer for supporting and printing materials, with the support layer comprising a knobbed grid structure with a hydrophobic coating. The coating is formed from a silicone film impervious to water and ink. Since water is used as the solvent for the ink, which can consist of 80% water, a dependable water-repellent or water-tight effect can be advantageously achieved. This offers the advantage, in addition to that of preventing soiling of the transport belt, that the water as solvent for the ink evaporates more slowly and hence drying on the transport belt is slowed down, which considerably facilitates subsequent transport belt cleaning.

The knobs of the transport belt can be configured as truncated cones or truncated pyramids. The design offers in particular the advantage that owing to the geometrical structure of the truncated cones or truncated pyramids the ink collects as a result of gravity on the bottom of the interstices, which can be regarded as a grooved structure, thereby preventing smearing on the back of the printing material being printed. Furthermore, absorption of the ink is prevented by the silicone film. This has the advantage not only of preventing soiling of the transport belt, but also that the water as solvent for the ink evaporates more slowly and hence drying on the transport belt is slowed down, which considerably facilitates subsequent transport belt cleaning.

The geometrical arrangement of the knobbed grid structure results in grid lines at an angle of 45° to the transport direction. This advantageously ensures that the leading edge of the printing material is always supported by the knobs over its entire width. The density of the printing material ensures that level contact with the transport belt is assured.

BRIEF DESCRIPTION OF THE DRAWINGS

Further features and advantages can be inferred from the sub-claims with reference to the description of the embodiment illustrated in the drawing.

In the drawings:

FIG. 3 shows a simplified diagrammatic view of an inkjet printer with the transport belt in accordance with the invention;

FIG. 4 shows a detailed view in accordance with the identifications in FIG. 3; and FIG. 5 shows a plan view onto the transport belt in accordance with FIG. 3.

DETAILED DESCRIPTION OF THE INVENTION

Figure 1:
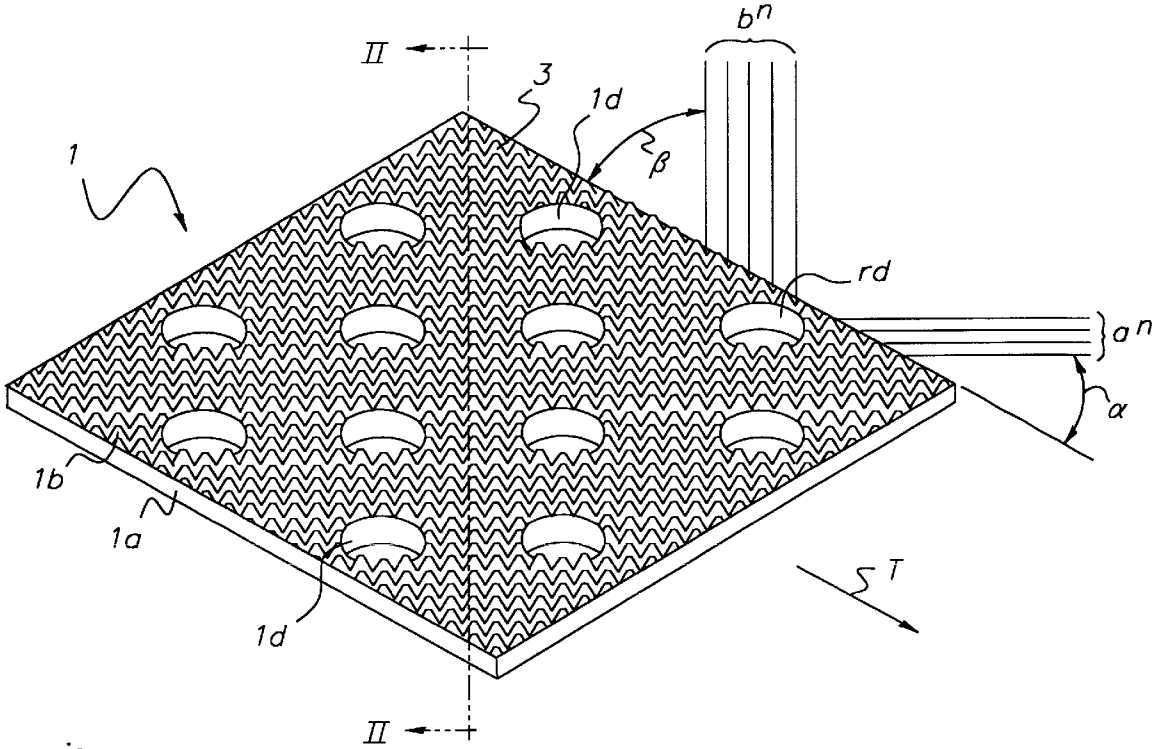
FIG. 1 shows a belt section in a transport belt in accordance with the invention.
Figure 2:
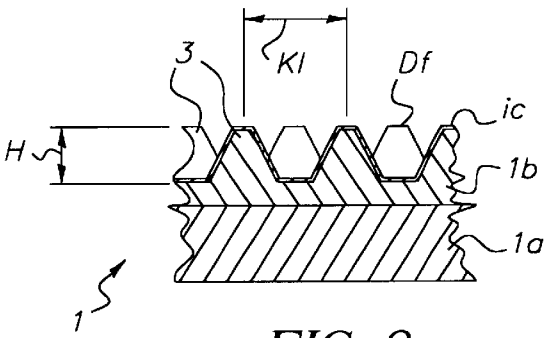
FIG. 2 shows a detailed view in a section along the line II—II in FIG. 1.

As shown in FIGS. 1 and 2, the transport belt 1 is formed by a carrier layer 1*a*, a support layer 1*b* and a hydrophobic and ink-rejecting layer 1*c*. The carrier layer la preferably comprises a polyester fabric, for example a belt with the designation SPH-11 from the company Habasit, in R ödermark, Germany. On said layer, the support layer 1*b* with a knobbed 3 grid structure is arranged, comprising polyurethane-elastomer (TPE-U) or one of the groups TE (PESTUR, PEESTUR, PEUR) as per ISO/VDA designation. The knobbed grid forms grid lines $a^n$, $b^n$ (n=number of lines, 1.n) equally spaced, forming an angle $\alpha$, $\beta$ of 45° relative to the transport direction T of belt 1, so that printing material 2 placed on the transport belt 1 and aligned parallel with the transport direction is not congruent with one of the grid lines at its leading, trailing or lateral edges. This ensures an optimum contact surface for the printing material 2 on the transport belt. The knobbed grid has along the grid lines $a^n$, $b^n$ an edge length (KL) of approx. 0.7 mm in each case, with the knobs preferably being configured as truncated cones or truncated pyramids.

The hydrophobic and ink-rejecting layer 1*c* is formed by a silicone layer that can be provided as a film or as a sprayed-on coating. The coating thicknesses here are approximately 0.03 to 0.08 mm, or 0.05 mm for the film. The application of the film to the support layer 1*b* is achieved by sufficiently known methods, for example using an adhesion-promoting primer or by shrinking by applying heat.

For fixing the printing material 2 on the transport belt 1, the latter is provided with openings 1*d* through which a negative pressure can be produced by means of a suction box of a known vacuum device 5 arranged between the drive roller and the deflecting roller of the transport belt. The result is a suction effect on the printing material 2, so that between the printing material surface to be printed and an inkjet printer 4 a defined parallel gap or space is created. This also determines in the known manner the quality of the print.

In accordance with FIG. 3, the transport belt 1 is designed as an endless belt which is moved via the deflecting roller 7 by the drive unit 6 comprising the motor M, the toothed belt and the drive roller, and the printing material 2, for example inkjet paper with gloss effect for creating photographic prints, can be supplied to the inkjet printer 4 with a possible transport belt speed of 40–80 cm/s.

The inkjet printer 4 comprises a print head 4.1 designed as a full-line model for generating a line-by-line color print with a maximum width of 25.4 cm (10 ins.), a sensor 4.2 not described in detail here for ascertaining the position of printing material 2 supplied to the print head, and ink supply containers, not shown, for creating the color print, with the possible ink ejection being 10–20 ml/m$^2$.

As shown in FIG. 3, the excess ink 4.3 applied to the belt is removed by a transport belt cleaning apparatus 8 arranged downstream of the inkjet printer 4 and the deflecting roller 7, using the air current generated by discharge/suction pumps $P_D$, $P_S$, as described in the parallel application (applicant's reference 1710.2).

The drive of the transport belt 6, the inkjet printer 4 with print head 4.1 and sensor 4.2, the vacuum suction device 5 and the pumps $P_D$, $P_S$ of the cleaning apparatus 8 is controlled by an electronic control unit 9.

For printing individual printing materials 2 with differing widths and lengths, which can for example correspond to the photographic 35 mm or APS sizes, these materials are placed onto the transport belt 1, as shown in FIG. 5, by means of a feed device, not shown, centered on the belt center $B_m$ and parallel to the transport direction T. Different spaces can result between the various printing materials. The respective printing materials are gripped in the firther course of transportation by the vacuum suction device 5 and fixed flat on the top surfaces Df of the knobs by the openings 1*d* provided in the transport belt. It is within the scope of the invention that instead of a vacuum device, other suitable holding means or methods can be used for the printing materials, for example by electrostatic charging of the transport belt, so that the latter can also be designed without openings 1*d*.

Since the inkjet print head 4 ejects ink in the fill maximum possible line width (full-line print) and there is no interruption of the printing process between the individual printing materials, problems such as the blind ejection of ink as necessary in German Patent 39 37 860 C2 for preventing the collection of air bubbles in the ink ducts of the print head are prevented. The excess ink 4.3 applied to the transport belt 1 as a result of the above operating mode of the inkjet printer 4 is reliably drawn off into the interstices of the knobbed grid structure by the design of the transport belt in accordance with the invention. Since the water of the ink used as solvent and the ink dyes are not absorbed by the transport belt, the ink can be removed from the transport belt 1 while wet by means of the cleaning apparatus 8. The ink impacting the openings 1*d* in the transport belt during the printing process is substantially drawn off by the vacuum suction device 5, with any remaining ink still adhering being completely removed by the transport belt cleaning apparatus 8.

PARTS LIST

1 transport belt
1*a* carrier layer
1*b* support layer
1*c* coating, hydrophobic and ink-rejecting
1*d* openings
1*e* outer surface
2 printing material
3 knobbed grid structure
4 inkjet printer
4.1 print head
4.2 sensor
4.3 ink/ink accumulation
5 vacuum suction device
6 belt drive
6*a* motor
6*b* drive roller
7 deflecting roller
8 transport belt cleaning apparatus
9 electronic control unit
10 inkjet printer
$\alpha,\beta$ angle of grid lines to transport direction
$a^n$, $b^n$ grid lines, n=number of lines
$B_m$ belt center
Df top surface
H height
$K_L$ edge length of knobbed grid structure
M motor
$P_D$ discharge pump
$P_S$ suction pump
T transport direction

What is claimed is:

1. An endless transport belt for receiving the ink, not ejected for printing purposes, of an inkjet printer, said transport belt comprising a support layer for supporting and printing printing materials of differing widths and lengths by means of an inkjet print head, wherein the support layer has a knobbed grid structure with a hydrophobic and ink-rejecting coating.

2. The transport belt according to claim 1, wherein the knobs are configured as truncated cones.

3. The transport belt according to claim 1, wherein the knobs are configured as truncated pyramids.

4. The transport belt according to claim 1, wherein the knobbed grid structure forms respective grid lines arranged at an angle of 45° to the transport direction.

5. The transport belt according to claim 4, wherein the knobbed grid structure has an edge length of 0.7 mm along each grid line.

6. The transport belt according to claim 1, the knobs have a height of 0.5 mm and a flat top surface area of 0.03 to 0.04 mm$^2$.

7. The transport belt according to claim 1, wherein the transport belt has openings which are arranged along the grid lines.

8. The transport belt according to claim 7, wherein the openings have a diameter of 3 to 5 mm and are arranged at a spacing of 5 to 8 mm.

9. The transport belt according to claim 1, wherein the support layer is a polyurethane layer.

10. The transport belt according to claim 1, wherein the hydrophobic coating is a silicone layer.

* * * * *